US009392872B2

(12) United States Patent
Saint Pierre et al.

(10) Patent No.: US 9,392,872 B2
(45) Date of Patent: Jul. 19, 2016

(54) MULTI-DIRECTIONAL BODY MOTION STACK CHAIR

(71) Applicant: Smith System, Plano, TX (US)

(72) Inventors: Kenneth J. Saint Pierre, Allen, TX (US); Maurice F. Johnson, Krum, TX (US); William Risdall, Dallas, TX (US)

(73) Assignee: Smith System, Plano, TX (US)

( * ) Notice: Subject to any disclaimer, the term of this patent is extended or adjusted under 35 U.S.C. 154(b) by 0 days.

(21) Appl. No.: 14/826,526

(22) Filed: Aug. 14, 2015

(65) Prior Publication Data

US 2015/0351550 A1 Dec. 10, 2015

Related U.S. Application Data

(63) Continuation of application No. 14/751,844, filed on Jun. 26, 2015, which is a continuation of application No. 14/199,004, filed on Mar. 6, 2014, now Pat. No. 9,072,384, which is a continuation-in-part of application No. 13/790,356, filed on Mar. 8, 2013, now abandoned.

(51) Int. Cl.

| | |
|---|---|
| ***A47C 3/04*** | (2006.01) |
| ***A47C 3/025*** | (2006.01) |
| ***A47C 7/44*** | (2006.01) |
| ***A47C 3/30*** | (2006.01) |
| ***A47C 7/14*** | (2006.01) |
| ***A47C 3/00*** | (2006.01) |

(52) U.S. Cl.

CPC ... *A47C 3/30* (2013.01); *A47C 3/00* (2013.01); *A47C 3/04* (2013.01); *A47C 7/14* (2013.01); *A47C 7/448* (2013.01)

(58) Field of Classification Search

CPC ..... A47C 7/443; A47C 7/445; A47C 7/446; A47C 7/448; A47C 3/04

USPC ..... 297/239, 285, 289, 296, 313, 314

See application file for complete search history.

(56) References Cited

U.S. PATENT DOCUMENTS

| | | | |
|---|---|---|---|
| 3,031,227 | A | 4/1962 | Van Buren, Jr. |
| 3,111,344 | A | 11/1963 | Hoven et al. |
| 3,261,037 | A | 7/1966 | Cermak et al. |
| 3,610,686 | A | 10/1971 | Caruso |
| 3,669,497 | A | 6/1972 | Massonnet |
| 3,708,202 | A | 1/1973 | Barecki et al. |
| 3,734,561 | A | 5/1973 | Barecki et al. |
| 4,002,369 | A | 1/1977 | Jennings |
| 4,057,288 | A | 11/1977 | Schwartz et al. |
| 4,400,031 | A | 8/1983 | DeDecker |
| 4,580,836 | A | 4/1986 | Verney |
| 4,603,904 | A | 8/1986 | Tolleson et al. |
| 4,733,910 | A | 3/1988 | Brennan |

(Continued)

*Primary Examiner* — Rodney B White

(74) *Attorney, Agent, or Firm* — Winthrop & Weinstine, P.A.

(57) ABSTRACT

The present invention comprises a chair that allows small, subtle multi-directional motion by the user while maintaining the functionality and space requirements of a stack chair. The chair of the present invention comprises motion that is facilitated by flexible supports mounted to the frame of the chair which suspend and support the chair's seat. A range of motion in the seat is thereby provided which is limited by integrated stopping mechanism built into the chair's frame. Allowing the user to change seating attitude with concomitant motion of the chair seat improves user comfort and prevents or delays user fatigue during long seating sessions while maximizing efficiency of work accomplished during a seating session.

10 Claims, 11 Drawing Sheets

(56) References Cited

U.S. PATENT DOCUMENTS

| | | | | |
|---|---|---|---|---|
| 4,869,552 | A | 9/1989 | Tolleson et al. | |
| 5,039,163 | A | 8/1991 | Tolleson | |
| 5,382,080 | A | 1/1995 | Gamberini et al. | |
| 5,452,937 | A | 9/1995 | Piretti | |
| 5,601,338 | A | 2/1997 | Wahls | |
| 5,868,468 | A | 2/1999 | Wang | |
| 5,904,397 | A | 5/1999 | Fismen | |
| 6,406,096 | B1 | 6/2002 | Barile, Sr. | |
| 6,471,293 | B2 | 10/2002 | Ware et al. | |
| 6,533,352 | B1 | 3/2003 | Glass et al. | |
| 6,679,551 | B2 | 1/2004 | Ware et al. | |
| 6,820,934 | B2 | 11/2004 | Ware et al. | |
| 6,896,327 | B1 | 5/2005 | Barile, Sr. | |
| 7,118,177 | B2 | 10/2006 | Piretti | |
| 7,416,252 | B2 | 8/2008 | Lor | |
| 7,681,952 | B2 | 3/2010 | Piretti | |
| 7,708,349 | B2 | 5/2010 | Chen | |
| 8,152,237 | B2 | 4/2012 | Saul | |
| 8,388,064 | B2 | 3/2013 | Bertolini et al. | |
| 8,567,864 | B2 | 10/2013 | Deisig et al. | |
| 8,820,835 | B2 | 9/2014 | Minino et al. | |
| 8,991,924 | B2 | 3/2015 | Piretti | |
| 9,072,384 | B2 * | 7/2015 | Saint Pierre | A47C 3/04 297/239 |
| 2005/0012369 | A1 | 1/2005 | Mendenhall et al. | |
| 2013/0099534 | A1 | 4/2013 | Barile, Jr. et al. | |
| 2014/0252823 | A1 | 9/2014 | Risdall | |
| 2015/0130236 | A1 * | 5/2015 | Rogers | A47C 3/04 297/239 |

* cited by examiner

MULTI-DIRECTIONAL BODY MOTION STACK CHAIR

CROSS-REFERENCE TO RELATED APPLICATIONS

This application is a continuation of application Ser. No. 14/751,844, filed Jun. 26, 2015, which is a continuation of application Ser. No. 14/199,004, filed Mar. 6, 2014 (now U.S. Pat. No. 9,072,384, issued Jul. 7, 2015), which is a continuation-in-part of application Ser. No. 13/790,356, filed Mar. 8, 2013, the entire contents of which are hereby incorporated herein.

BACKGROUND OF THE INVENTION

Field of the Invention

The invention relates generally to a stackable chair that also facilitates subtle multi-directional body positional and/or attitude adjustment by the user. More specifically, the invention provides in various embodiments a chair seat that is balanced and suspended upon shock absorbers that allow the chair seat to move with the user.

BRIEF SUMMARY OF THE INVENTION

The present invention comprises a chair that allows small, subtle multi-directional motion by the user while maintaining the functionality and space requirements of a stack chair. The chair of the present invention comprises motion that is facilitated by flexible supports, i.e., shock absorbers, mounted to the frame of the chair which suspend and support the chair's seat. A range of motion in the seat is thereby provided which is limited by an integrated stopping mechanism built into the chair's frame. Allowing the user to change seating attitude with concomitant motion of the chair seat improves user comfort and prevents or delays user fatigue during long seating sessions while maximizing efficiency of work accomplished during a seating session.

The figures and the detailed description which follow more particularly exemplify these and other embodiments of the invention.

Figure 1:
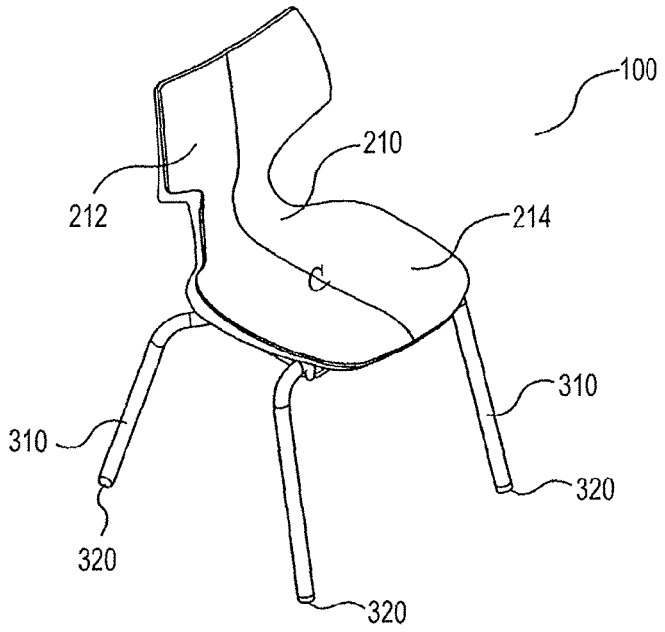
FIG. 1 illustrates a perspective view of one embodiment of the chair of the present invention.
Figure 2:
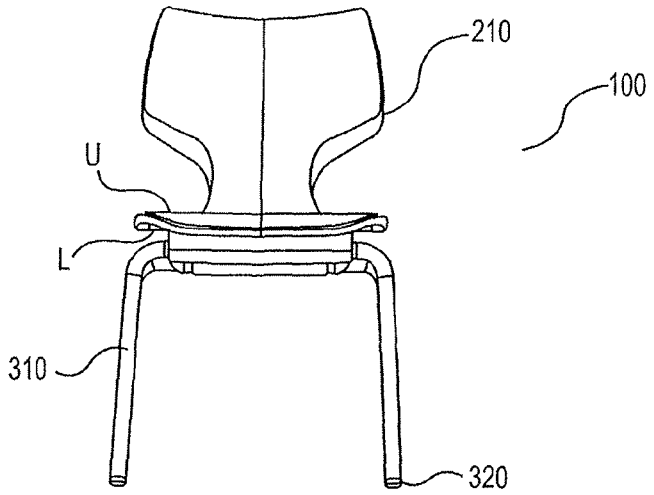
FIG. 2 illustrates a front view of one embodiment of the chair of the present invention.
Figure 3:
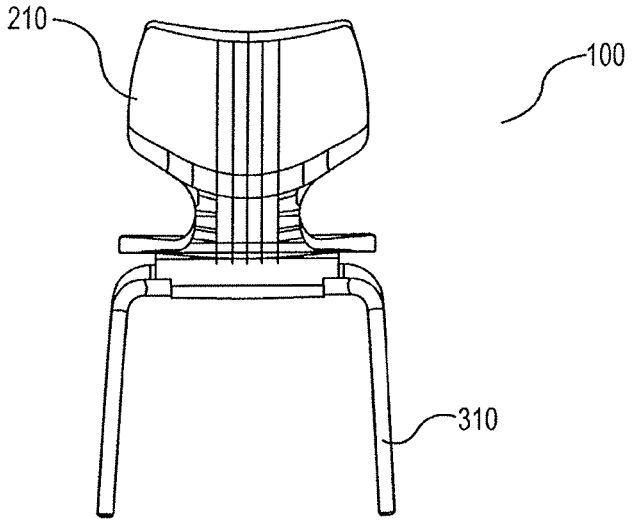
FIG. 3 illustrates a rear view of one embodiment of the chair of the present invention.
Figure 4:
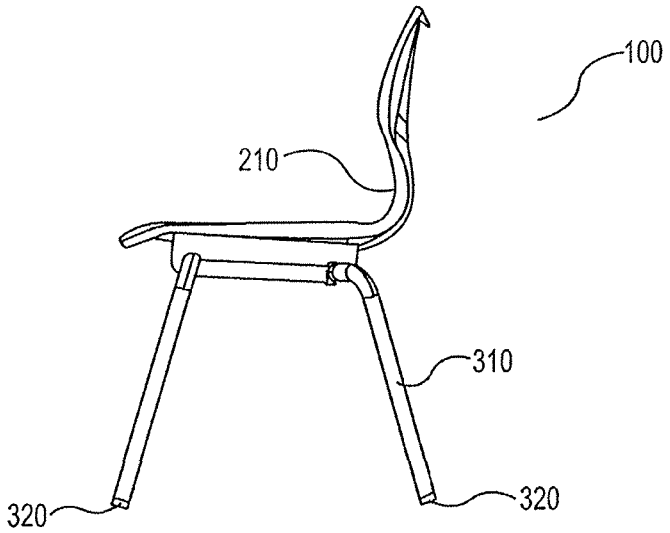
FIG. 4 illustrates a side view of one embodiment of the chair of the present invention.
Figure 5:
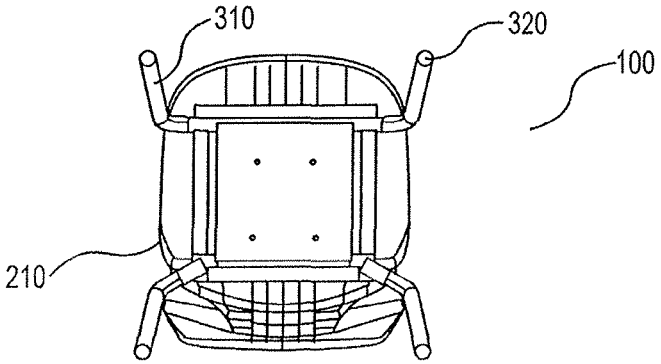
FIG. 5 illustrates a bottom view of one embodiment of the chair of the present invention.

The invention may be more completely understood in consideration of the following detailed description of various embodiments of the invention in connection with the accompanying drawings, which are as follows.

DETAILED DESCRIPTION OF THE INVENTION, INCLUDING THE BEST MODE

While the invention is amenable to various modifications and alternative forms, specifics thereof are shown by way of example in the drawings and described in detail herein. It should be understood, however, that the intention is not to limit the invention to the particular embodiments described. On the contrary, the intention is to cover all modifications, equivalents, and alternatives falling within the spirit and scope of the invention.

FIGS. 1-5 provide perspective, front, rear, side and bottom views, respectively, of one embodiment of the chair 100 of the present invention. Chair seat 210 is shown in operative connection and communication with chair legs 310 and further comprising an upper portion 212 in operative connection and communication with a base section 214. Legs 310 further comprise swivel glides 320 operatively disposed and connected at a distal end of each leg 310. The swivel glides 320 are pivotable to allow the chair 100 to accommodate surfaces that are not substantially level as is well known in the art.

Figure 6:
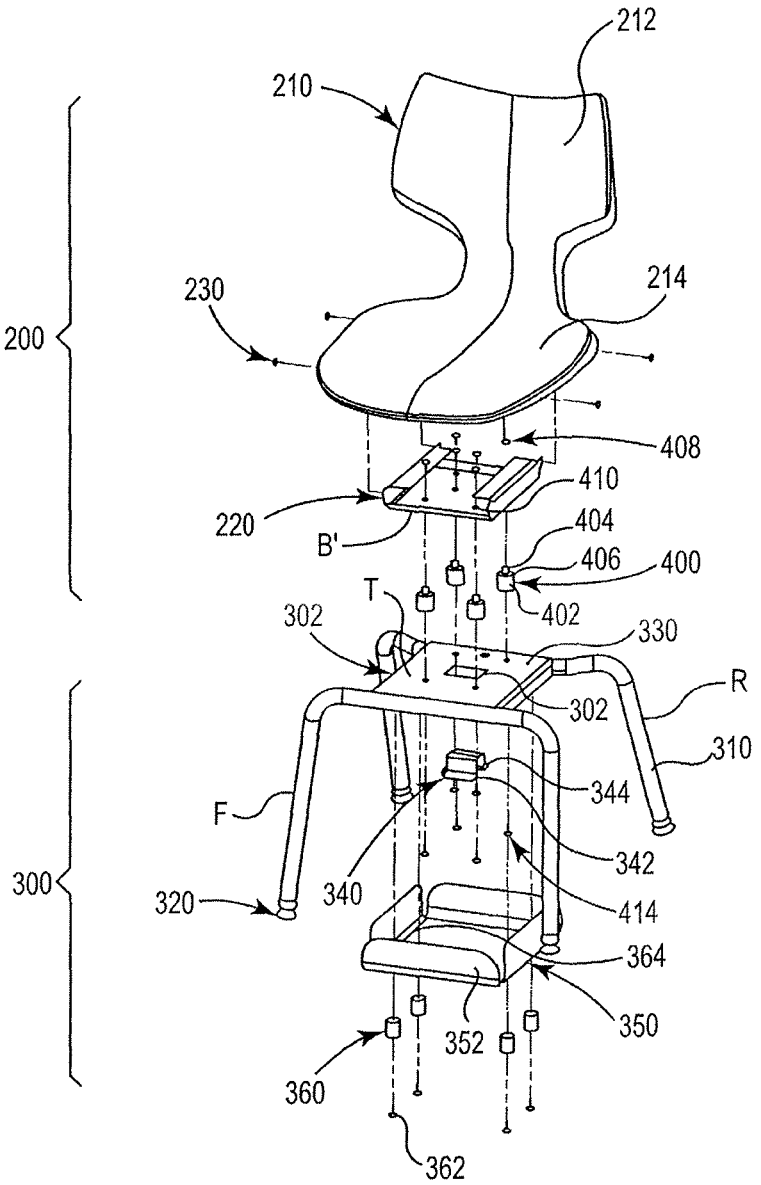
FIG. 6 illustrates an exploded view of one embodiment of the chair of the present invention.
Figure 7:
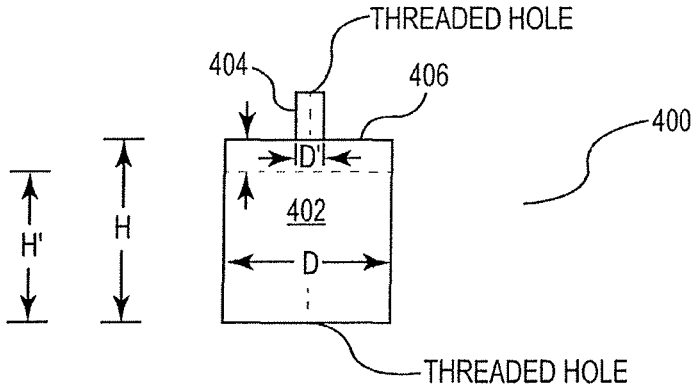
FIG. 7 illustrates a partial cutaway view of one embodiment of a shock absorber of the present invention.

FIGS. 6 and 7 provide exploded views of the elements of one embodiment of the chair 100 of the present invention. Thus, an upper section 200 is in operative communication with a lower section 300 of chair 100. Certain of the elements in this embodiment are also illustrated in the alternate embodiment of FIG. 12.

Upper section 200 comprises chair seat 210 discussed supra. Seat 210 may be formed of a variety of materials, including molded plastic, wood and equivalents thereof as is well known to the skilled artisan. Furthermore, the seat 210 is illustrated as a unitary structure comprising the upper portion 212 and seat base 214. However, as the skilled artisan will readily recognize, the seat base 214 may be separated from the upper section 212. Each such equivalent material and seat 210 configuration is within the scope of the present invention.

With reference to the Figures, the seat base 214 of seat 200 comprises an upper side U and a lower side L and will have a geometric center denoted by "C". Upper section 200 further comprises upper seat plate 220 which is in secured and fixed connection with the lower side L of seat base 214. The secured fixed connection may comprise mechanical securements using, e.g., fasteners 230 of a type well known to the skilled artisan, e.g., rivets or machine screws or the like through pre-drilled holes 232 in upper seat plate 220 and which also engage predrilled holes (not shown) in the lower side L of seat base 214 which align with upper seat plate holes 232 as the skilled artisan will readily understand.

Lower section 300 of chair 100 comprises frame 302 comprising chair legs 310 and a lower base plate 330. Chair legs 310 are in fixed attachment with the lower base plate 330 by, e.g., weldment or other fixed connection solutions well known to the skilled artisan. The lower base plate 330 is thus arranged between the legs 310 which are shown as comprising a front pair F and a rear pair R. With this arrangement, the front and rear pairs F,R of legs are functionally able to stand as illustrated in the Figures. As discussed above, each leg 310 comprises a distal end where a swivel glide 320 is disposed via known mechanical attachment for aid in adapting to flooring that is less than level.

Lower section 300 of chair further comprises a rocker stop bracket 340 in operative connection and communication with lower base plate 330. Side flanges 342 on rocker stop bracket 340 engage the bottom side B of lower base plate 330 while a vertical central section 344 of bracket 340, located between and adjacent the side flanges 342, extends through a complementarily shaped cutout 302 in lower base plate 330. Stop bracket 340 functions to limit the range of motion the upper section 200 of chair can undergo. A preferred profile for the bracket 340 and, as a result for the vertical central section 344, is that of a rectangle. Consequently, the preferred shape for the complementarily shaped cutout 302 is also that of a rectangle. However, a wide variety of geometrical configurations and shapes for bracket 340 and cutout 302 are readily ascertainable by the skilled artisan, including, e.g., and without limitation, square, pentagonal, hexagonal, etc. Each of these equivalent configurations and shapes are within the scope of the present invention.

Further, lower section 300 comprises a bottom cover 350 in operative communication with lower base plate 330 and legs 310 as well as a plurality of stack bumpers 360 in operative communication with the bottom cover 350. As illustrated stack bumpers 360 comprise a predrilled threaded hole therethrough that is engaged by a screw 362 which also threadingly engages predrilled holes 364 in bottom cover 350. A preferred number of stack bumpers 360 is, as illustrated, four, however a number of additional configurations and numbers of stack bumpers 360 are readily ascertainable to the skilled artisan, each of these configurations and numbers of stack bumpers 360 are within the scope of the present invention. Stack bumpers 360 allow several chairs 100 to be stacked upon one another without damage as is known in the art; thus the chair 100 of the present invention is stackable.

Interposed between the upper section 200 and the lower section 300 are a plurality of shock absorbing elements, for example, the illustrated threaded rubber bushings 400. The skilled artisan will recognize a variety of equivalent alternative shock absorbing elements, for example and without limitation, air shock absorbers and spring shock absorbers may be considered possible equivalent alternatives and are, as a result, within the scope of the preset invention. In each embodiment of the present invention, the upper section 200 thus balances on, and is suspended by, the shock absorbing elements, e.g., the illustrated rubber bushings 400. Bushings 400 are in operative communication with the top surface T of lower base plate 330 as well as in operative communication with the bottom surface B' of upper seat plate 220. A preferred number and configuration of the plurality of shock absorbing elements, e.g., the bushings 400 is, as illustrated, four and in generally a square or rectangular pattern. However, a number of equivalent numbers and configurations of shock absorbing elements, e.g., the bushings 400 will readily present themselves to the skilled artisan; each such equivalent is within the scope of the present invention.

Figure 8:
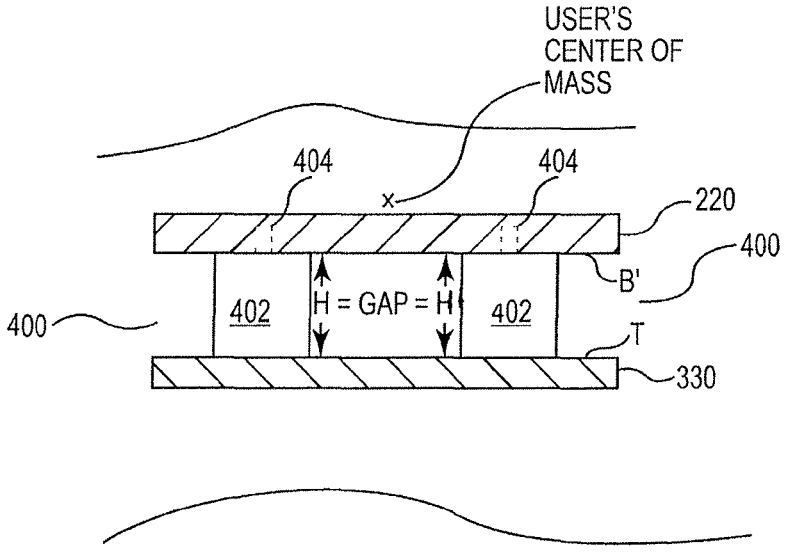
FIG. 8 illustrates a partial cutaway view of one embodiment of the present invention.
Figure 9:
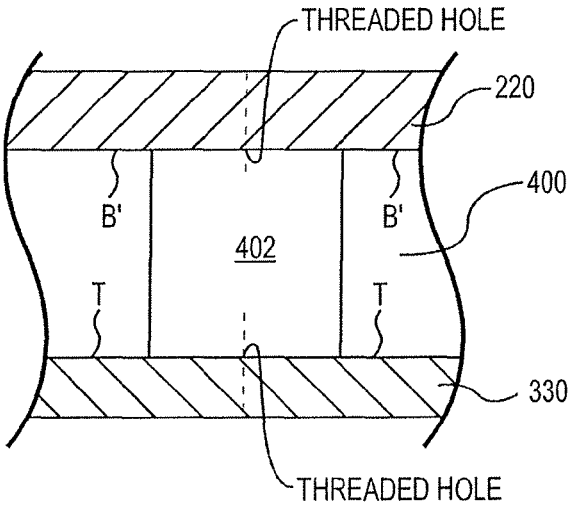
FIG. 9 illustrates a partial cutaway view of one embodiment of a shock absorber of the present invention.

Bushings 400 may comprise a body 402 with a diameter D and a height H and an upward facing nipple 404 rising generally vertically above body 402 and having a diameter D' smaller than the diameter of body's diameter, creating a shoulder 406 adjacent the nipple 404. Thus, in certain embodiments, the body 402 rests upon the top surface T of lower plate 330 while nipple 404 may comprise a threaded hole therein which may comprise in certain embodiments a threaded stud, and further engage a predrilled hole 410 through the upper seat plate 220 where a screw 408, which may further comprise a securing nut, may secure the upper seat plate 220 to the threaded hole in nipple 404 as illustrated in FIGS. 6-8. In certain embodiments, bushings 400' may comprise a body 402' with a diameter and no nipple as the skilled artisan will recognize and as illustrated in FIG. 9. In this embodiment, a screw, e.g., 408, may secure the upper seat plate 220 via threaded hole in body 402' while the lower base plate and body 402' are secured as described above with a screw and aligned holes.

Further, body 402 may comprise a threaded hole therein which may align with a predrilled hole in lower base plate 330. Thus, body 402 may be secured to lower base plate 330 by engaging the predrilled hole 412 in lower base plate 330 and threadingly engaging the threaded hole in body 402 with a screw 414 as illustrated in FIG. 6. Thus, upper section 200 of chair 100 is effectively suspended upon the rubber bushings 400, primarily by the shoulders 406.

The body 402 of bushings 400 are, in turn secured upon lower section 300 of chair, creating a functional gap between the upper section 200 and lower section 300 of chair. Specifically, a gap is created as best illustrated in FIGS. 8 and 9 between the upper seat plate 220 of the upper section 200 of chair 100 and lower base plate 330 of the lower section 300 of chair 100. The height of the gap will, in an unloaded situation, i.e., without a user seated on chair 100, correspond to the height H of the body 402 of bushings 400. Finally, in certain embodiments such as that illustrated in FIG. 6, bottom cover 350 may further comprise upwardly facing side flanges 352 in order to provide pinch protection wherein the flanges 352 cover the gap created between upper seat plate 220 and lower base plate 330 by the interposing presence of rubber bushings 400.

Figure 10A:
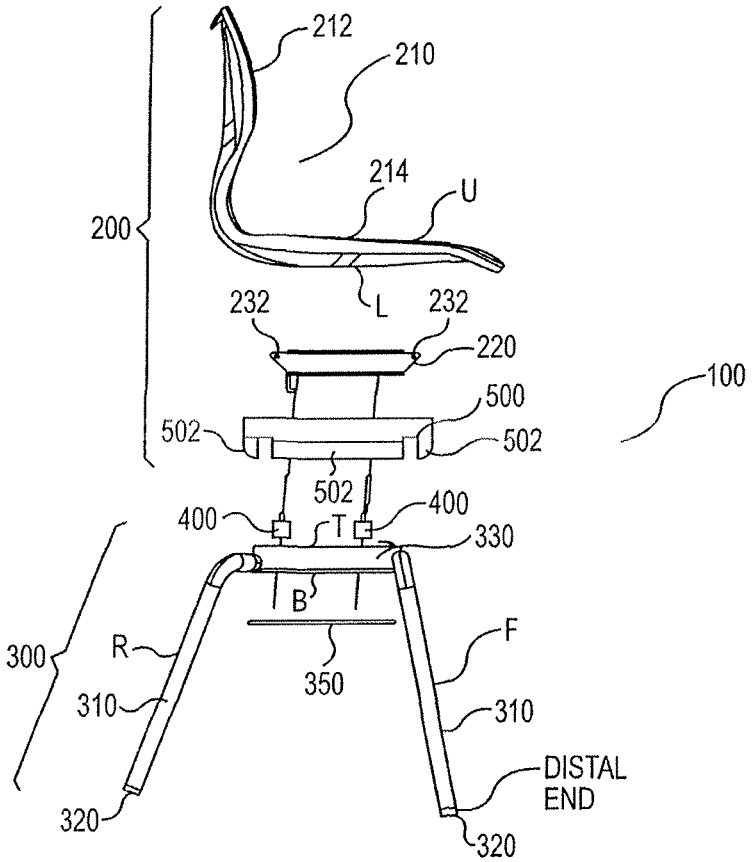
FIGS. 10A and 10B illustrate a partial exploded view of one embodiment of the chair of the present invention.
Figure 10B:
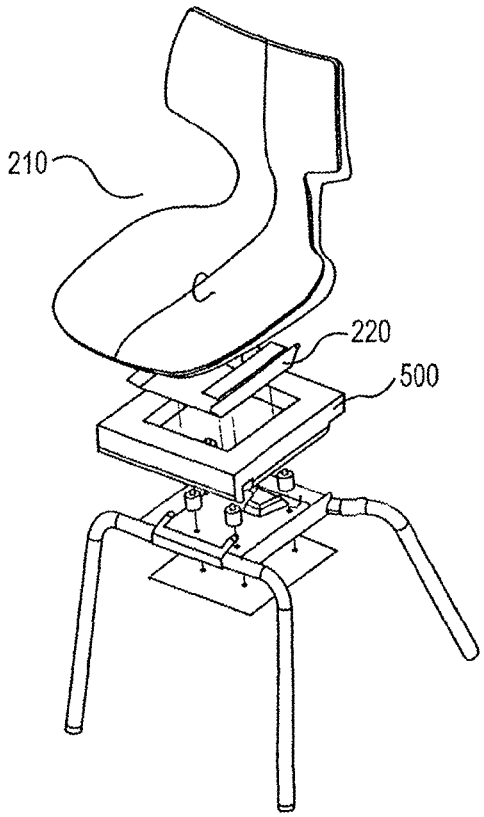

In certain alternative embodiments, as illustrated in FIGS. 10A and 10B, a shroud 500 may be placed between the upper seat plate 220 and lower base plate 330 in order to provide pinching protection. Shroud 500 may comprise side flanges 502 to cover the gap created between upper seat plate 220 and lower base plate 330 by the interposing presence of rubber bushings 400. In this embodiment, bottom cover 350 does not comprise side flanges 352 as in the embodiment of FIG. 6 because the shroud 500 comprises protective side flanges 502, rendering bottom cover flanges 352 of the embodiment of FIG. 6 unnecessary.

The chair 100 of the present invention thus assembled, a user may sit on chair seat 210 and may sit substantially balanced in the center of the chair seat 210, suspended on the shock absorbing elements, e.g., rubber bushings 400. In this case, the mass of the user is substantially equally displaced through the rubber bushings 400 upon which the upper section 200 of the chair 100 rests. This is illustrated by the "x" in FIG. 8, corresponding to the general center of mass of the user seated on chair seat 210 and transmitted down to upper seat plate 220. In other words, the rubber bushings 400 will, in this instance, be substantially equally loaded and the chair seat 210 retains its initial non-deformed attitude and position but is slightly lower. This is achieved by a slight compression of the bushing body 402, each body 402 compressing substantially the same amount. Thus, the chair seat 210 comprises an initial attitude and position wherein the user's weight is substantially balanced in the center of chair seat 210. In this position, the rubber bushings 400 may be compressed, but are substantially equally compressed. Stated differently, the height H of shock absorbing elements, e.g., bushings 400, is less than H, e.g., H' as in FIG. 7, when a user is seated on chair 100 than when no user is seated because the bushings compress. In this case, the height of each of the compressed bushings 400 is approximately the same, i.e., H' as illustrated by the dashed line and bi-directional arrows.

Figure 11:
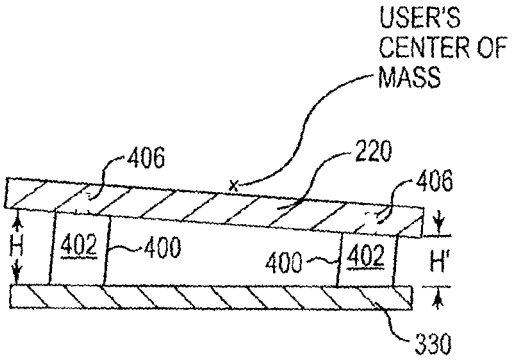
FIG. 11 illustrates a partial cutaway view of one embodiment of the present invention.

If, however, during the course of a seating session, the user wishes to shift his or her position or attitude, the chair seat 210 will respond to this position shift with a concomitant change of position. This change of position of chair seat 210 is in response to the change of weight distribution when the user changes his or her position. An exemplary situation is illustrated in FIG. 11, wherein two bushings 400 are illustrated with a body 402 and nipple 406 in secured and operational connection and communication with upper plate 220 and lower base plate 330. Base plate 330 does not move in response to a shift in user's weight. In this case, as opposed to the balanced situation shown in FIG. 8, the user's center of mass, denoted by "x" is no longer centered and balanced on chair seat but has shifted to one side. In this situation, the weight of the user is not equally displaced through the rubber bushings 400, i.e., the rubber bushings 400 will not be loaded equally and at least one of the rubber bushings 400 will comprise a compressed deformation away from the balanced situation described above wherein the user's weight is substantially centered in the chair seat 210. This is illustrated by the bushing 400 that is furthest from the center of mass "x" comprising an essentially uncompressed height H, while the bushing 400 that is closer to the shifted center of mass "x" is compressed, indicated as height H', which is shorter than H. Thus, since the rubber bushings 400 flex and compress, the chair seat 210 will change its position in response. Thus, the chair seat 210 comprises a second loaded attitude and position wherein the chair seat 210 moves in response to the user's shifted weight, i.e., shifted away from being substantially equally displaced to substantially unequally displaced. Stated differently, the upper section 200 of the chair 100, which is suspended and balanced on the rubber bushings 400, is allowed by the present invention to change its position and attitude in the direction of the user's weight shift.

As the seating session progresses, the user may shift his or her weight multiple times. In response, the weight shifts of the user are transferred through the chair seat 210 and the upper plate 220 to the rubber bushings 400 suspending the upper section 200 of the chair 100. The rubber bushings 400 deform accordingly in response to the transferred weight shift and displacement, allowing the upper section 200 of the chair 100, to shift in the direction of the weight shift of the user.

Generally, at least one shock absorbing element, e.g., rubber bushing 400 will compress when the user's center of mass shifts away from the center of the chair seat 210. Thus, each of the plurality of shock absorbing elements, e.g., rubber bushing 400, are capable of independently compressing in response to weight changes or shifts of weight or center of mass of the user on the chair seat 210. This independent compression for each shock absorbing element allows the chair seat 210 to move in response to provide the user with a more comfortable seating experience.

Figure 12:
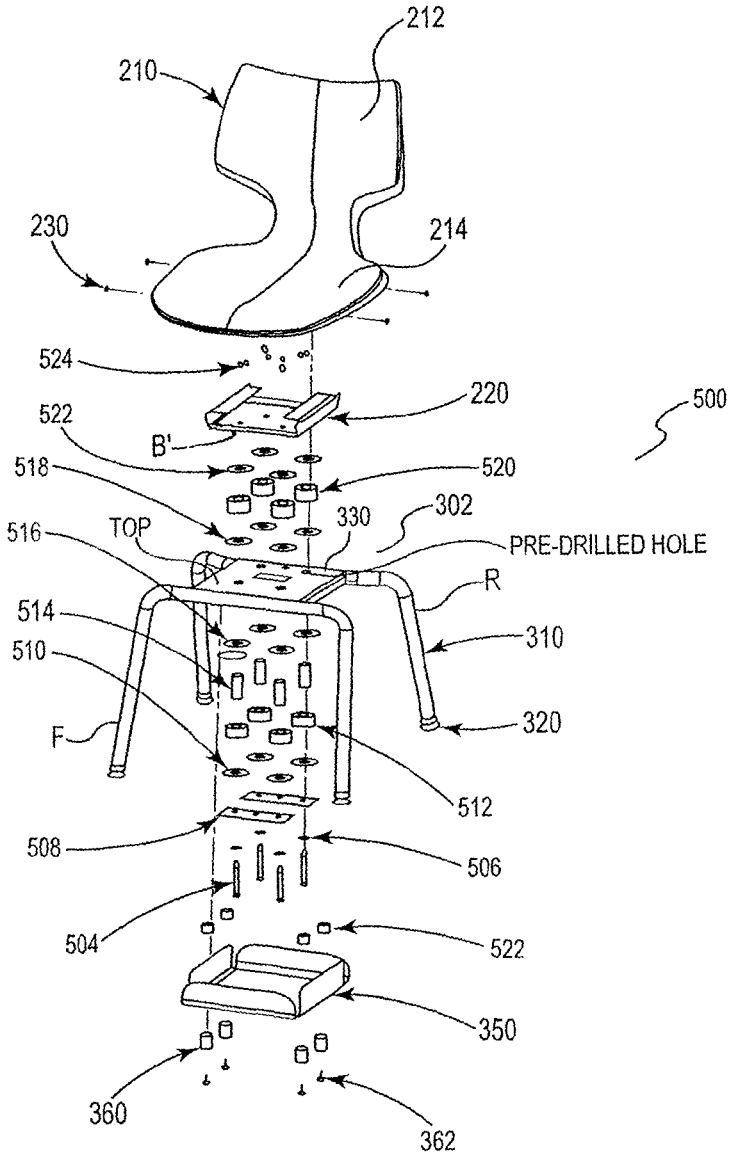
FIG. 12 illustrates an exploded view of an alternate embodiment of the chair of the present invention.

Turning now to FIG. 12, an alternate embodiment 500 is provided.

As shown, the upper seat plate 220 is mechanically fastened to the base frame 302 using at least four machine screws 504. Each machine screw 504 pass through, in order of engagement, flat washer 506, group washer 508, a first buffer washer 510, lower compressible bushing 512 wherein lower compressible bushing 512 comprises a passage therethrough to accommodate engaging machine screw 504, an insulating bushing 514 wherein each insulating bushing 514 comprises a passage therethrough to accommodate engaging machine screw 504 and wherein passage through lower compressible bushing 512 engages and accommodates the insulating bushing as well as the engaging machine screw, a second buffer washer 516, predrilled hole in lower base plate 330 of frame 302, a third buffer washer 518, upper compressible bushing 520 having a passage therethrough sufficient to accommodate engaging machine screw 504, a fourth buffer washer 522, and finally engaging a pem nut 524 or an equivalent fastening element.

As illustrated, there are four such assemblies 500 as in FIG. 12 wherein four individual machine screws 504 pass through and engage the structures defined herein and this is the preferred structure. However, it is within the scope of the invention to have four or more of the described assemblies. For example, there may be four or more machine screws 504, four or more flat washer 506, four or more group washers 508, four or more first buffer washers 510, four or more lower compressible bushings 512, four or more second buffer washers 516, four or more predrilled holes in lower base plate 330 of frame 302, four or more third buffer washers 518, four or more upper compressible bushings 520, four or more fourth buffer washers 522, and finally four or more pem nuts 524 or equivalent fastening element.

Figure 13:
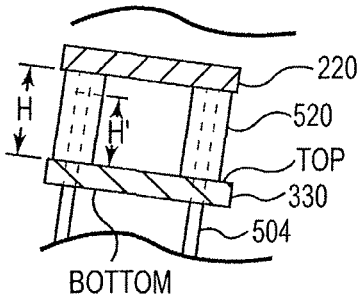
FIG. 13 illustrates a partial cutaway view of one embodiment of an upper bushing of the present invention.
Figure 14:
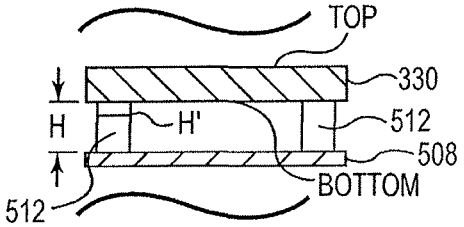
FIG. 14 illustrates a partial cutaway view of one embodiment of an upper bushing of the present invention.

When this alternate embodiment 500 is thus assembled, each upper compressible bushing 520 engages the upper seat plate 220 and the lower base plate 330, effectively suspending the upper seat plate 220 above the lower base plate 330 at a differentially compressible distance equivalent to the height of the upper compressible bushing 520, when no weight is received on the seat. In addition, the lower compressible bushings 512 provide another set of differentially compressible elements to enhance the chair's functionality and the user's comfort during elongated seating sessions, effectively suspending lower base plat 330 a differentially compressible distance from group washer 508. Similar to the arrangement and function for element 400 described above in relation to FIGS. 8 and 11 and as illustrated in FIG. 13, the height H of the upper compressible bushings 520 may change as a user's center of mass shifts over the seat during a seating session, compressing one or more of the upper compressible bushings 520 to achieve a compressed height and as indicated by H' in FIG. 13. In addition, the height H of the lower compressible bushings 512 may also change as the bushings 512 compress in response to the user's weight or pressure distribution across the seat to achieve a compressed height H' as is illustrated in FIG. 14. When the weight or pressure is not evenly distributed across seat, the compression of the upper compressible bushings 520 will not be identical relative to each other, nor will the compression of the lower compressible bushings 512 be identical with each other. This differential in the changing in height, i.e., the degree of compression, of the upper compressible bushing(s) 520, relative to the other upper compressible bushing(s) 520, and of the lower compressible bushing(s) 512, relative to the other lower compressible bushing(s) 512, results in a change in attitude of the seat itself, providing relief to the user.

In this alternate embodiment, the relative movement of the seat, as allowed by the relative changing in height of the upper bushing(s) 502, is limited by the presence and effect of the fastened machine screw 502 and group washer 508 engaging the lower bushings and insulating bushings 512, 514 and the additional elements in the described assembly. Each of the bushings 512, 514 and 520 are preferably composed of rubber, though other materials may be understood as useful by the skilled artisan and, therefore, within the scope of the present invention.

In addition, bottom cover 350 is in operative communication and connection with lower base plate 330 and legs 310 as described above in regard to FIGS. 1-5. However, the alternate embodiment in FIG. 12 further comprises four cover spacers 522, which are engaged by screws 362. The cover spacers 522 are preferably composed of rubber, though other materials may be understood as useful by the skilled artisan and, therefore, within the scope of the present invention. Cover spacers 522 are thus interposed between the bottom cover 350 and lower base plate 330, forming a buffer to assist in protecting the chairs when stacked upon each other.

The upper differentially compressible bushings 520 and the lower differentially compressible bushings 512 are illustrated generally as rubber bushings as commonly known in the art. However, as described above, bushings 520 and 512 may also comprise air shocks or gas springs while achieving the functionality described herein.

Thus, the present invention may accommodate what the skilled artisan will now recognize as an infinite number of positional directional and attitudinal changes of weight balance by the user, the magnitude of which is limited in the present invention by the presence of rocker stop bracket 340 which stops the chair seat 210 motion when engaged.

The present invention should not be considered limited to the particular examples described above, but rather should be understood to cover all aspects of the invention. Various modifications, equivalent processes, as well as numerous structures to which the present invention may be applicable will be readily apparent to those of skill in the art to which the present invention is directed upon review of the present specification.

What is claimed is:

1. A stackable chair comprising:

an upper section comprising:

a seat having a seat base, the seat base comprising a lower side, and an upper seat plate secured to the lower side of the seat base;

a lower section in operative connection with the upper section and comprising:

a frame comprising chair legs and a lower base plate, wherein the chair legs are secured to the lower base plate; and a plurality of shock absorbing elements consisting of four shock absorbing elements interposed between the upper section and the lower section, wherein the upper section is suspended upon the shock absorbing elements, and wherein each of the four shock absorbing elements is capable of independent compression in response to pressure changes on the seat and having an uncompressed height, and wherein each of the four shock absorbing elements comprises an uncompressed height and wherein each one of the four shock absorbing elements is capable of compression in response to pressure changes on the seat and thereby achieving a compressed height that is lower than the uncompressed height and that may be different from the heights of each of the other shock absorbing elements.

2. The stackable chair of claim 1, wherein the plurality of shock absorbing elements are disposed between the upper seat plate of the upper section and the lower base plate of the lower section.

3. The stackable chair of claim 1, wherein the four shock absorbing elements are arranged in a generally square pattern.

4. The stackable chair of claim 1, wherein the four shock absorbing elements are arranged in a generally rectangular pattern.

5. The stackable chair of claim 1, wherein the four shock absorbing elements comprise rubber.

6. The stackable chair of claim 1, wherein the plurality of shock absorbing elements comprise rubber.

7. A stackable chair comprising:

an upper section comprising:

a seat having a seat base, the seat base comprising a lower side, and an upper seat plate secured to the lower side of the seat base;

a lower section in operative connection with the upper section and comprising:

a frame comprising chair legs and a lower base plate, wherein the chair legs are secured to the lower base plate; and a plurality of shock absorbing elements consisting of four shock absorbing elements interposed between the upper seat plate of the upper section and the lower base plate of the lower section, wherein the upper section is suspended upon the shock absorbing elements, and wherein each of the four shock absorbing elements is capable of independent compression in response to pressure changes on the seat and having an uncompressed height, and wherein each of the four shock absorbing elements comprises an uncompressed height and wherein each one of the four shock absorbing elements is capable of compression in response to pressure changes on the seat and thereby achieving a compressed height that is lower than the uncompressed height and that may be different from the heights of each of the other shock absorbing elements.

8. The stackable chair of claim 7, wherein the four shock absorbing elements are arranged in a generally square pattern.

9. The stackable chair of claim 1, wherein the four shock absorbing elements are arranged in a generally rectangular pattern.

10. The stackable chair of claim 7, wherein the four shock absorbing elements comprise rubber.

* * * * *